US005673770A

United States Patent [19]

Friedman

[11] Patent Number: 5,673,770

[45] Date of Patent: Oct. 7, 1997

[54] SLIDING DOOR ASSEMBLY FOR AN ELEVATOR AND METHOD OF INSTALLING SAME

[76] Inventor: Harold S. Friedman, 15 Poplar Dr., Roslyn, N.Y. 11576

[21] Appl. No.: 591,358

[22] Filed: Jan. 25, 1996

[51] Int. Cl.[6] ..... B66B 13/06

[52] U.S. Cl. ..... 187/333; 52/30

[58] Field of Search ..... 187/324, 313, 187/325, 333, 334, 401, 414; 52/30, 204.1, 217

[56] References Cited

U.S. PATENT DOCUMENTS

| | | | |
|---|---|---|---|
| 408,509 | 8/1889 | Nickerson | 187/319 |
| 478,246 | 7/1892 | Stoner | 187/325 |
| 643,307 | 2/1900 | Schmitt | 160/197 |
| 1,838,524 | 12/1931 | Brown | 187/330 |
| 1,954,363 | 4/1934 | Moyer | 187/335 |
| 3,686,808 | 8/1972 | Loomis | 52/211 |
| 3,741,351 | 6/1973 | Suozzo | 187/95 |
| 4,530,189 | 7/1985 | Randall | 52/30 |
| 4,735,293 | 4/1988 | Everhart et al. | 187/56 |
| 5,139,111 | 8/1992 | Baumann et al. | 187/333 |
| 5,445,244 | 8/1995 | Ketonen | 187/325 |
| 5,479,754 | 1/1996 | Pelvilain et al. | 52/745.16 |

OTHER PUBLICATIONS

Sliding Elevator Door Assembly Inside Shaftway.
Sliding Elevator Door Assembly In Hallway.
Sliding and Swinging Elevator Entrance Door.

*Primary Examiner*—Kenneth Noland
*Attorney, Agent, or Firm*—Eliot S. Gerber

[57] ABSTRACT

The sliding door assembly for an elevator and a method for replacing an existing swinging elevator door with a sliding elevator door. The swinging door assembly is removed and is replaced in situ with a sliding elevator door assembly. A portion of the wall adjacent to the elevator door is removed, permitting the sliding door to slide into the part of the wall which has been removed. The part of the wall which has been removed and in which the sliding door fits is covered by a stationary panel. In another embodiment, there are two sliding doors that slide behind the side stationary panel. A left sliding entrance door and a right sliding entrance door are in separate planes so that one of the doors can slide behind the other.

21 Claims, 9 Drawing Sheets

SLIDING DOOR ASSEMBLY FOR AN ELEVATOR AND METHOD OF INSTALLING SAME

BACKGROUND OF THE INVENTION

Two types of elevator entrance assemblies that are commonly used to provide access to elevators are swing entrance doors and sliding entrance doors. Swing entrance doors open by pivoting about a hinge when the door handle is pulled. Sliding entrance doors open by traveling along a linear track in tandem with an elevator cab door. This invention relates to a sliding entrance door assembly for an elevator and method of converting an existing swing entrance door assembly into a new sliding entrance door assembly.

Many older buildings have swing entrance assemblies on their elevators. Access to an elevator with a swing entrance door, however, is recognized as dangerous and difficult for people with disabilities. Therefore, the Americans with Disabilities Act (ADA) "Accessibility Guidelines for Buildings and Facilities" state that elevator doors shall open and close automatically. The Guidelines further state that elevator doors shall be provided with a reopening device that will stop and reopen a car door automatically if the door becomes obstructed by an object or a person. A swing entrance door that opens and closes automatically in order to conform to this provision is not permitted by the elevator code. Swing entrance doors may also pose a danger to the disabled if the disabled individual cannot avoid the path of the swinging entrance door. Due to the practical disadvantages of swing entrance doors and the requirements in the Americans with Disabilities Act, there has been a need to convert an elevator swing entrance door assembly into a sliding entrance door assembly.

One prior art method of converting a swing entrance door assembly into a sliding entrance door assembly consists of using the interior elevator car space for the sliding entrance door assembly (See FIG. 3). Under this method the size of the elevator car is reduced to provide for the sliding entrance door assembly. This reduction in size of the elevator car is a major drawback to this technique. A smaller elevator car makes it more difficult for a wheelchair bound individual to turn around after entering the elevator. Furthermore, the Americans with Disabilities Act "Accessibility Guidelines for Buildings and Facilities" sets minimum dimensions for the depth of elevator cars. If the distance between the back wall and front wall of the elevator car is less than 51 inches, the car will not comply with the Guidelines. Therefore, using this method could cause a violation of the ADA. For elevator cars that are already less than 51 inches, reducing the elevator car further exasperates the problems associated with small elevators.

In addition to the hardship imposed on the disabled, smaller elevator cars are inconvenient for all elevator users. Reducing the size of the elevator car reduces the number of passengers the car can hold and makes the car more crowed.

Another prior art method of converting a swing entrance door assembly into a sliding entrance door assembly consists of using the hallway space for the sliding entrance door assembly (See FIG. 4). Under this method the wall adjacent to the elevator opening must be demolished and reconstructed. A sliding entrance door frame is affixed to the hallway side of the wall. The portion of the floor in the hallway that will be used for the sliding entrance door assembly must be cut out and removed. In the open position, the sliding entrance door slides between the reconstructed wall and the sliding entrance door frame. There are many drawbacks to using this technique. This method reduces the size of the hallway by the width of the sliding entrance door frame. This method is also dangerous since after demolition of the wall the elevator shaft is exposed. Thus, it will be necessary to construct a partition covering the exposed area. Overall this method is more dangerous, more time consuming and more costly than the present invention.

SUMMARY OF THE INVENTION

In accordance with the principles of the present invention, the shortcomings of the aforementioned constructions have been overcome through a new and improved sliding entrance door assembly and installation process. Specifically, it is now possible to construct a sliding entrance door assembly for an elevator with minimum construction, noise, dirt, disruption, and delay as well as with greater safety. Under the principles of the present invention, a sliding entrance door may be installed that uses stationary panels affixed to the elevator door frame. The stationary panels are comprised of a side panel and a transom panel. The side panel replaces the wall adjacent to the elevator opening. The transom panel is located above the sliding entrance door and the side panel. In the open position, the sliding entrance door is positioned behind the side panel portion of the stationary panel. By using the present invention, the sliding entrance door can operate without using a significant portion of the hallway or shaftway space.

In an alternative embodiment of the present invention, a left sliding entrance door and a right sliding entrance door are installed. The left sliding entrance door and the right sliding entrance door are in separate planes so that one of the doors can slide behind the other. One of the sliding entrance doors slides faster than the other so that both the left sliding entrance door and the right sliding entrance door complete the slide approximately simultaneously behind the side stationary panel.

DETAILED DESCRIPTION OF THE INVENTION

Figure 1:
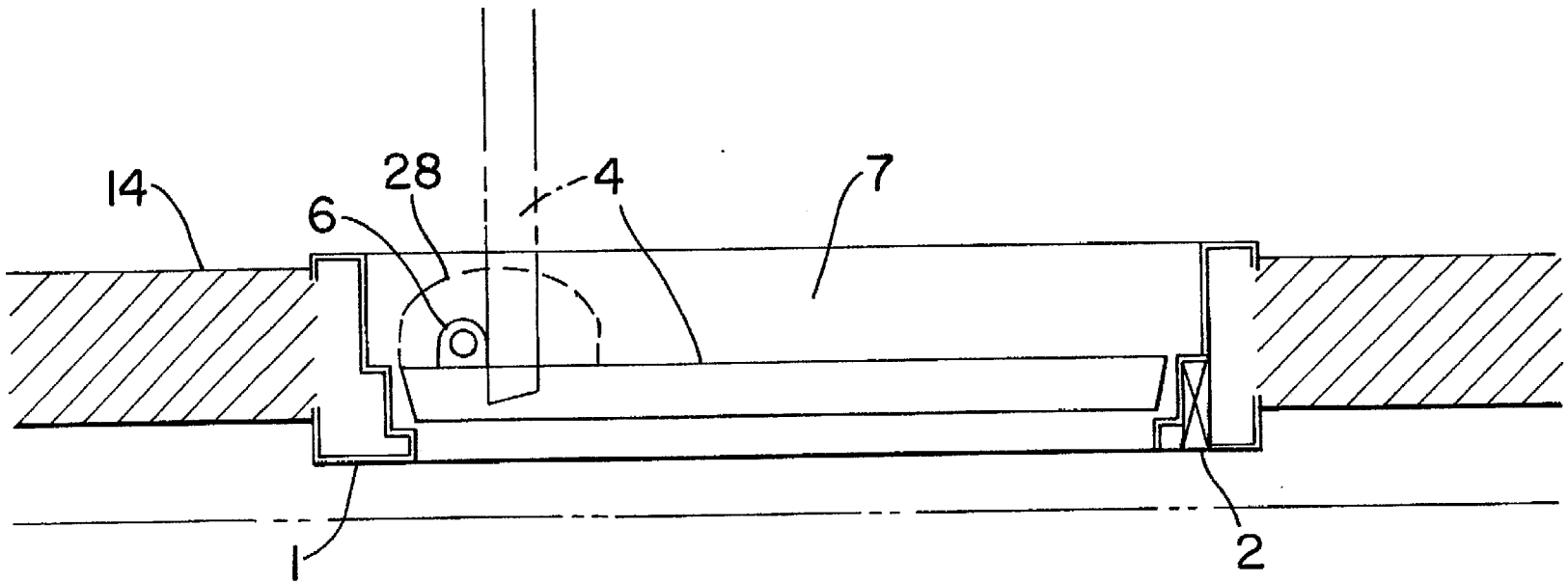
FIG. 1 PRIOR ART
FIG. 1 is a top view of a prior art swing entrance door assembly.
Figure 2:
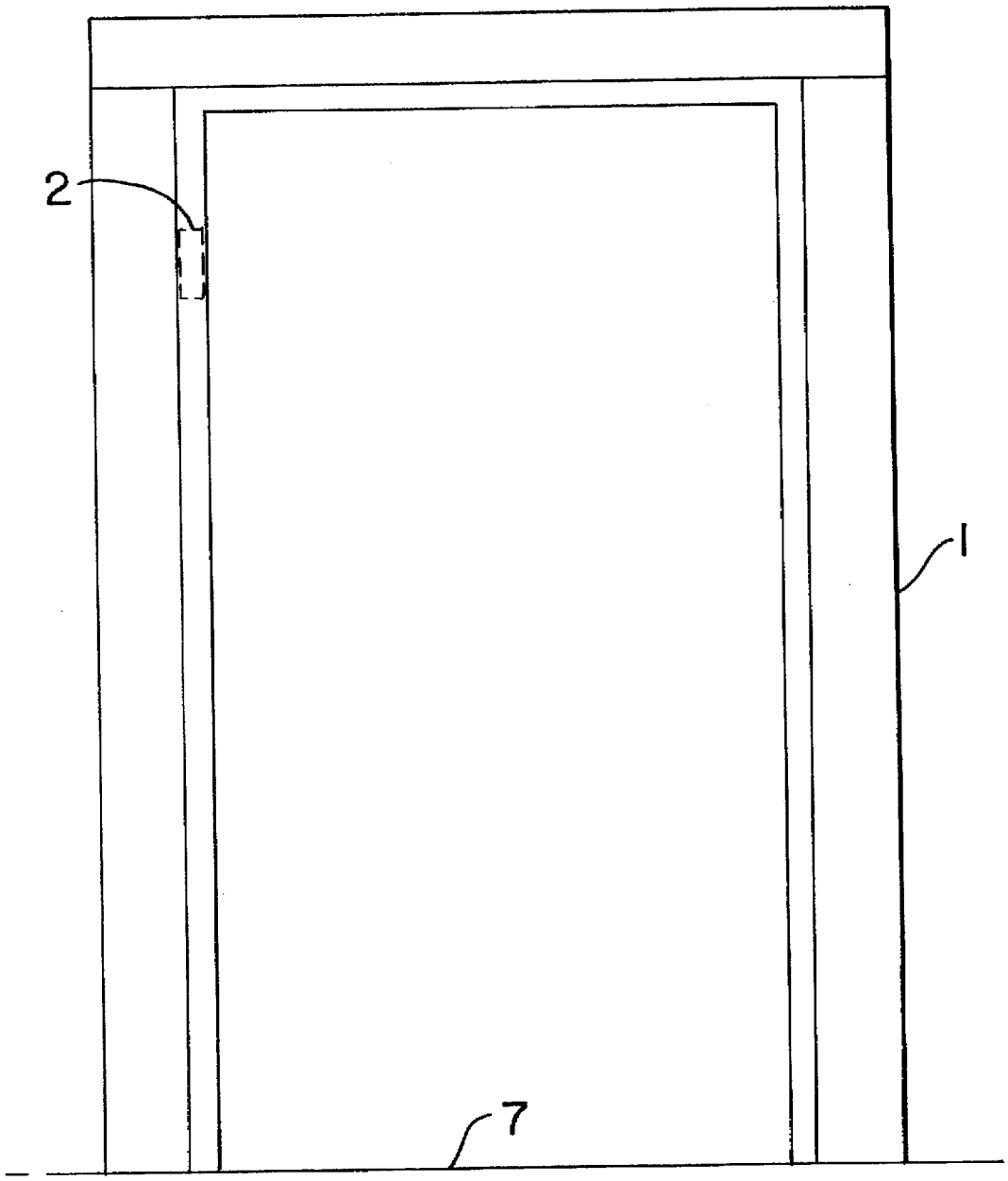
FIG. 2 PRIOR ART
FIG. 2 is an elevation of a prior art swing entrance door assembly with door removed.

FIG. 1 and FIG. 2 show a swing entrance door for an elevator. An elevator door frame 1 surrounds the elevator opening in the wall 14. Attached to the elevator door frame 1 is a door interlock 2 which prevents the swing entrance door 4 from opening when the elevator car is not present. The swing entrance door 4 pivots about a hinge 6 which is attached to the elevator door frame 1. A sill 7 is attached to the door frame 1. Attached to the elevator door is a door check 28 that controls the speed at which the swing door opens and closes.

Figure 3:
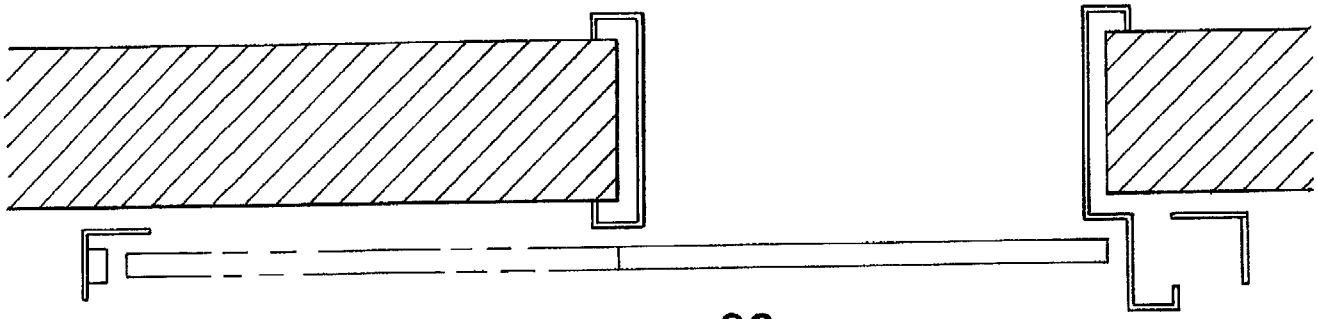
FIG. 3 PRIOR ART
FIG. 3 is a top view of a prior art sliding entrance door assembly which was converted from a swing entrance door.

FIG. 3 shows a prior art sliding entrance door assembly which was converted from a swing entrance door assembly. In this construction the interior elevator car space 26 is used for the sliding entrance door assembly. This technique is unsatisfactory because it reduces the size of the elevator car.

Figure 4:
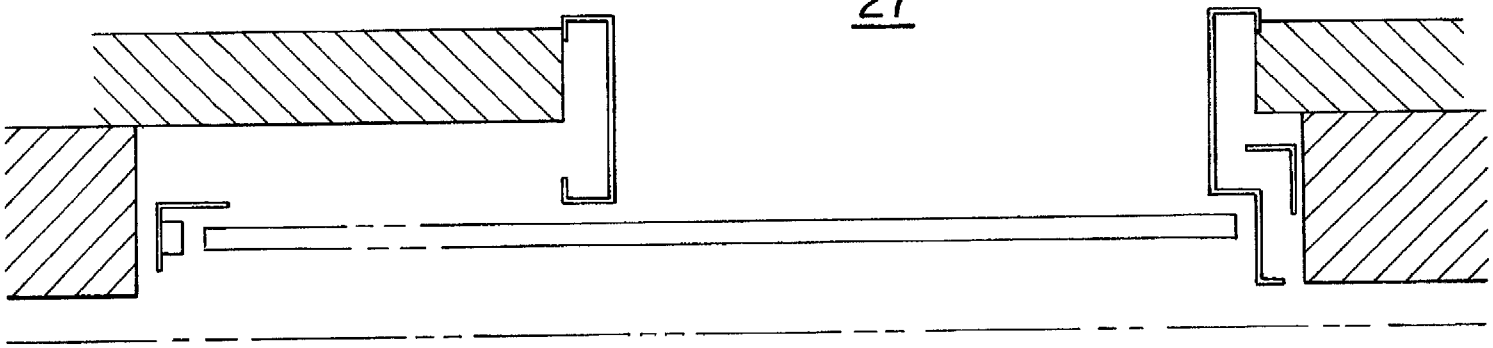
FIG. 4 PRIOR ART
FIG. 4 is a top view of another prior art sliding entrance door assembly which was converted from a swing entrance door.

FIG. 4 shows another prior art sliding entrance door assembly which was converted from a swing entrance door assembly. In this construction the hallway space 27 is used for the sliding entrance door assembly. This technique is unsatisfactory because it reduces the size of the hallway and is dangerous, time consuming and costly.

Figure 5:
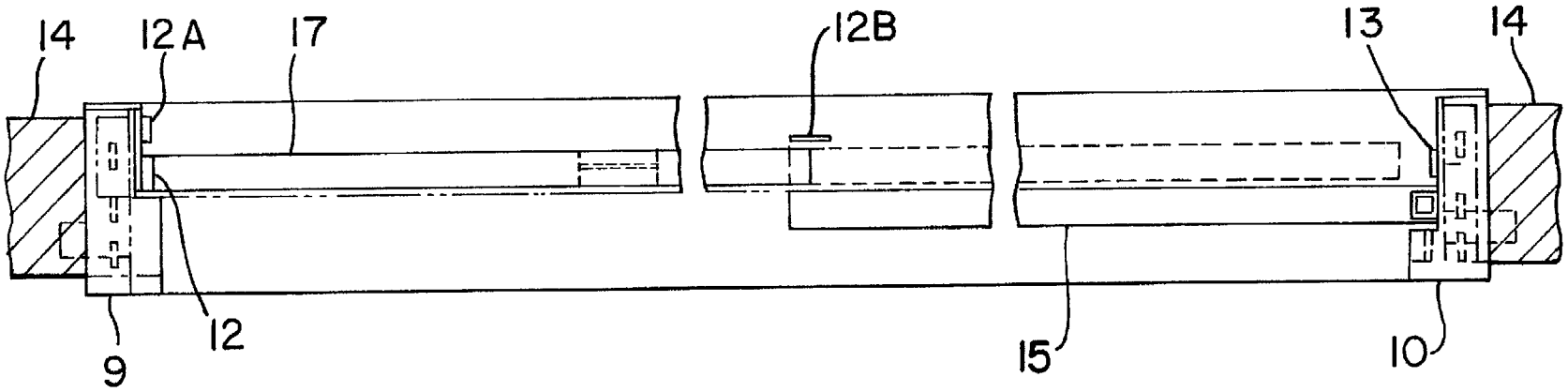
FIG. 5 is a top view of a sliding entrance door assembly of the present invention.
Figure 6:
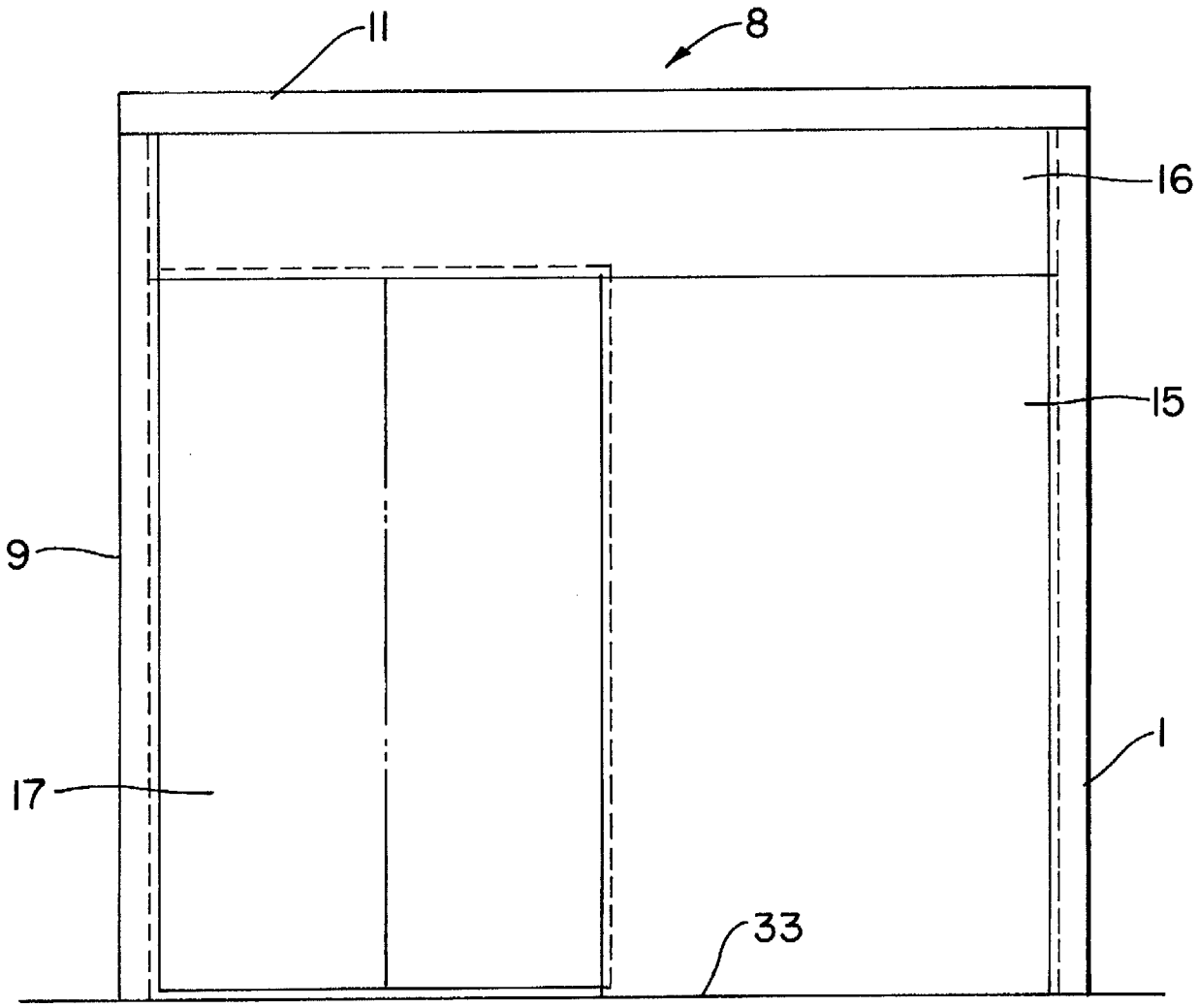
FIG. 6 is an elevation view of a sliding entrance door assembly of the present invention.
Figure 7:
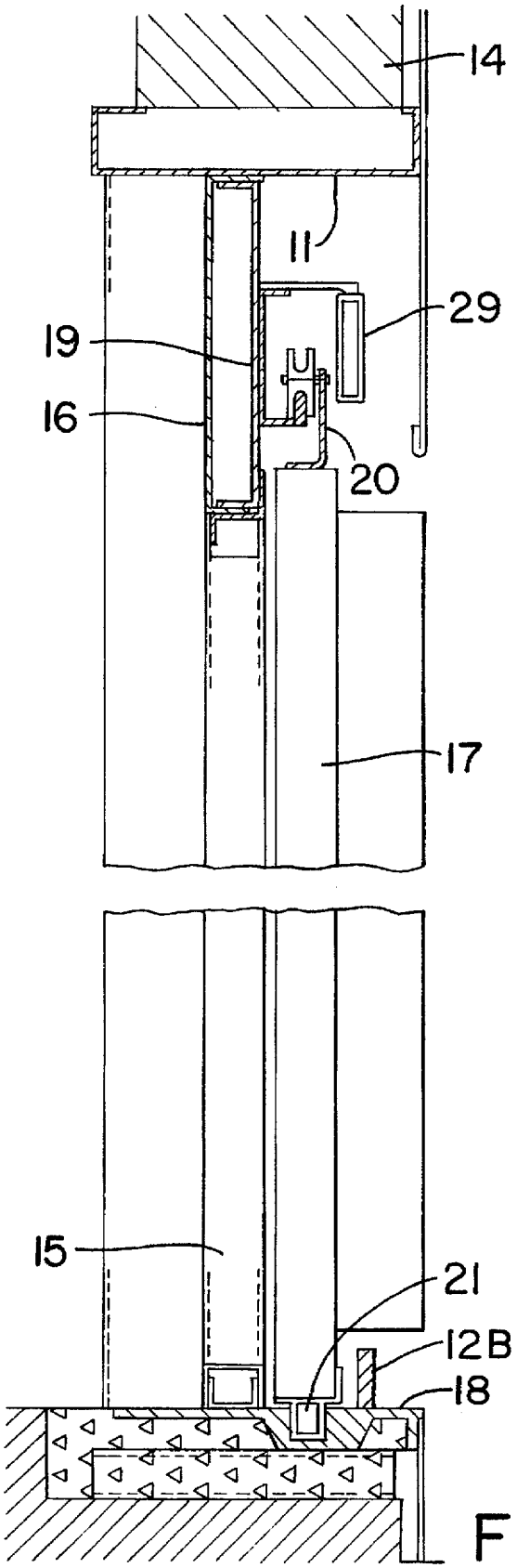
FIG. 7 is a side view of a sliding entrance door assembly of the present invention.

FIGS. 5, 6 and 7 show a sliding entrance door assembly according to this invention. In this assembly an elevator frame 8 is constructed within the opening of the block wall. The elevator frame is comprised of a left post 9, a right post 10 and a top post 11. Mounted to the frame are a left door bumper 12 and a right door number 13 to absorb the impact of the sliding entrance door 17. A left door stop **12*a* and a right door stop 12*b* are mounted to the slide sill 18 to prevent the sliding entrance door 17** from being pushed into the elevator car.

Affixed within the elevator frame 8 are stationary panels. The stationary panels are comprised of side panel 15 which is located adjacent to the sliding entrance door 17 and a transom panel 16 in the transom area which is located above the sliding entrance door 17 and the side panel 15. The lower portion of the side panel 15 is affixed to a slide sill 18. The slide sill 18 is positioned on the floor between the left post 9 and right post 10 of the elevator frame 8. The slide sill 18 is comprised of a strong material such as cast iron. The slide sill 18 has a groove which defines a lower track 19 for the sliding entrance door.

The stationary panels are comprised of a strong material such as steel and may be fire-resistant. The stationary panels may be hollow and contain strengthening supports. The strengthening supports may be channel-shaped. The stationary panels may range in thickness from about 1 inches to about 3 inches. In a preferred embodiment the panels range in thickness from about 1⅜ inches to about 1 ¾ inches.

The size of the sliding entrance door 17 is slightly larger than the opening defined by the transom panel 16, side panel 15, slide sill 18 and left post 9 enabling the sliding entrance door to substantially seal the opening.

An upper track 19 is mounted on the transom panel 16 and hangers 20 are mounted on the top of the sliding entrance door 17 which associate with the upper track 19 enabling the sliding entrance door 17 to travel smoothly in a linear path. Wheels, rollers or gibs 21 are affixed to the bottom of the sliding entrance door 17 for assisting the sliding entrance of the door in the lower track 19 of the slide sill 18.

An interlock 29 is mounted on the transom panel 16. The interlock 29 prevents the sliding entrance door 17 from opening when it is not positioned adjacent to the elevator car.

The sliding entrance door assembly of the present invention can readily be constructed from a swing entrance door assembly without using a substantial portion of the hallway or shaft way area. To construct a sliding entrance door assembly of the present invention from the swing entrance door assembly of FIG. 1, the existing elevator door assembly must be removed. This requires removing the swing entrance door 4, the door interlock 2, the sill 7, the door check 28 and the elevator door frame 1 of the swing entrance door assembly. A portion of the block wall 14 adjacent to the elevator entrance must also be removed. In order to prepare for the installation of the slide door assembly, a slide sill pocket is cut out of the floor between the left post 9 and the right post 10 to allow the slide sill 18 to fit therein. After removal of the swing entrance door structures and preparation of the elevator door site, the replacement sliding entrance elevator door assembly is installed. This includes installing the slide sill 18, the elevator frame 8, the door bumper 12, the left door stop **12*a*, the right door stop 12*b*, the side panel 15, the transom panel 16, the upper track 19, hangers 20 and the sliding entrance door 17**.

The interlock 29 is installed on the elevator door frame 1 to prevent the sliding entrance door 17 from opening when the sliding entrance door 17 is not positioned adjacent to the elevator car.

After the plumbness of the assembly is inspected, concrete is poured between the elevator frame 8 and the block wall 14 for bonding the elevator frame 8 to the block wall 14.

Figure 8:
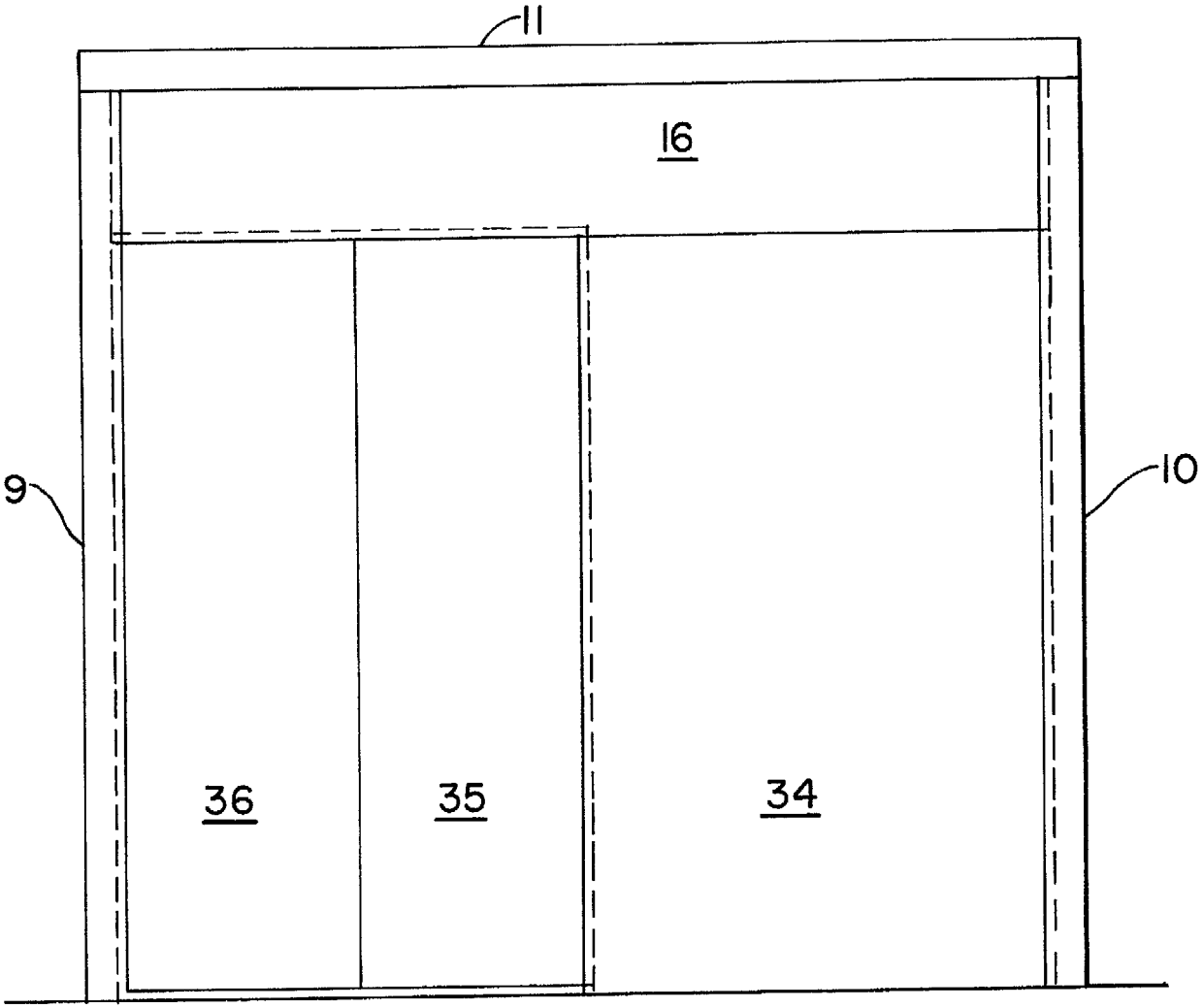
FIG. 8 is an elevation view of the sliding entrance door assembly having two sliding entrance doors.
Figure 9:
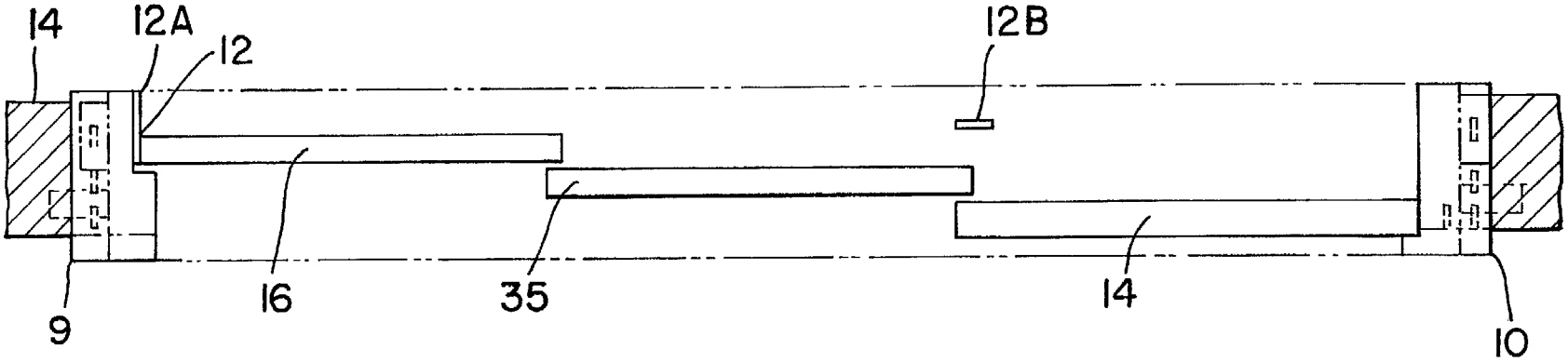
FIG. 9 is a top view of an alterative embodiment of the sliding entrance door assembly having two sliding entrance doors.
Figure 10:
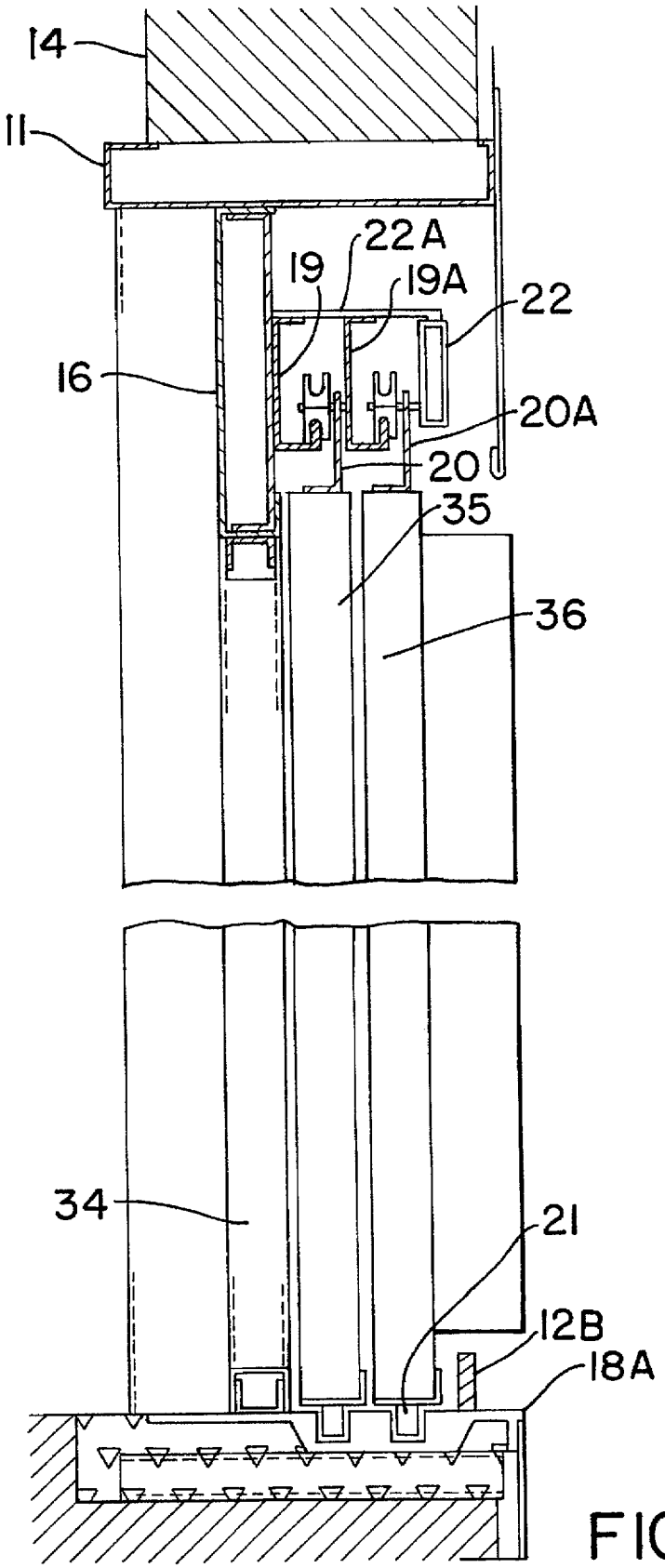
FIG. 10 is a side view of the alternative embodiment of the sliding entrance door assembly having two sliding entrance doors.

FIGS. 8, 9 and 10 show an alternative embodiment of the present invention. In this embodiment there is a left sliding entrance door 36 and a right sliding entrance door 35 in two different planes. The left sliding entrance door 36 and the right sliding entrance door 35 slide in the same direction. When the elevator entrance doors open, the left sliding entrance door 36, right sliding entrance door 35 and the side stationary panel 34 line up in three separate planes. Since there are two elevator entrance doors in this embodiment, the side stationary panel can be narrower than the one used in the single door embodiment.

In this embodiment a slide sill **18*a* has two grooves that define two lower tracks for the left sliding entrance door 36 and right sliding entrance door 35. An upper track 19 is mounted on the transom panel 16 and hangers 20 are mounted on the top of the right sliding entrance door 35 which associate with the upper track 19 enabling the right sliding entrance door 35 to travel smoothly in a linear path. An upper track 19*a* is mounted to a brace 22*a* which is attached to the transom panel 16. Hangers 20*a* are mounted to the top of the left sliding entrance door 36 which associate with the upper track 19*a* enabling the left sliding entrance door 36 to travel smoothly in a linear path. An interlock 22 is mounted on the brace 22*a*. The interlock 22 prevents the left sliding entrance door 36 and right sliding entrance door 35** from opening when they are not positioned adjacent to the elevator car.

When the elevator entrance doors open, the right sliding entrance door 35 slides behind the stationary panel 34 and the left sliding entrance door 36 slides behind the right sliding entrance door 35. The left sliding entrance door slides faster than the right sliding entrance door so that both doors complete the slide approximately simultaneously.

The foregoing description of the invention should be considered as illustrative, and not as limiting. Various changes and modifications will occur to those skilled in the art, without departing from the true scope of he invention as set forth in the following claims.

I claim:

1. A method for replacing an existing swing entrance door assembly for an elevator with a replacement sliding entrance door assembly, which comprises:

(a) Removing the existing swing entrance door assembly;

(b) Removing part of an existing adjacent wall to provide a space into which a replacement sliding entrance door can slide;

(c) Preparing an elevator door site for installation of the replacement sliding entrance door assembly;

(d) Installing the replacement sliding entrance door assembly in the space formerly occupied by the elevator swing entrance frame and the part of the adjacent wall and the transom proximal to the elevator swing entrance frame, without the replacement sliding entrance door assembly protruding into the hallway or elevator shaftway, viewed from the hallway, the replacement sliding entrance door assembly comprising a frame having a left post, forming the left hand boundary of the frame, a right post, forming the right hand boundary of the frame, a top post, connecting the left post and the right post, and the replacement sliding entrance door; and (e) Installing a stationary panel on the frame, the stationary panel comprising a transom.

2. A method according to claim 1 in which said stationary panels comprise a side panel and a transom panel.

3. A method according to claim 1 in which the replacement sliding entrance door assembly includes a replacement elevator door frame and the replacement sliding entrance door.

4. A method according to claim 1 wherein the swing entrance door assembly comprises a swing entrance door, an interlock, a door check, a sill, and an elevator entrance frame.

5. A method according to claim 1 wherein removing the swing entrance door assembly comprises:

(a) Removing the existing swing entrance door;

(b) Removing the existing door check;

(c) Removing the existing elevator door frame; and (d) Removing the existing sill for the elevator door.

6. A method according to claim 1 wherein preparing the elevator door site comprises:

(a) Preparing said elevator door site for the installation of a replacement door frame; and (b) Preparing an existing swing sill pocket and the adjacent floor for installation of the replacement slide sill between the left and right posts.

7. A method according to claim 1 wherein installing the replacement sliding entrance door assembly comprises:

(a) Setting the replacement slide sill; and (b) Installing the replacement door frame for the replacement sliding entrance elevator door assembly;

(c) Installing the stationary panels on the exterior of the adjacent wall area, the stationary panels comprising the side panel and the transom panel;

(d) Installing hangers on the replacement sliding entrance elevator door;

(e) Installing a track on the transom for the replacement sliding entrance elevator door;

(f) Installing the replacement sliding entrance elevator door;

(g) Installing right and left door stops; and (h) Installing an interlock on the transom.

8. A method according to claim 1 in which the replacement elevator entrance frame is bonded to the adjacent wall with concrete.

9. A method according to claim 1 in which the stationary panels are fire-resistant.

10. A method according to claim 9 in which the stationary panels comprise hollow structures containing strengthening supports.

11. A method according to claim 10 in which the strengthening supports are channel-shaped.

12. A method according to claim 10 in which the stationary panels are enclosed in sheet steel of a thickness of at least 14 gauge.

13. A method according to claim 1 in which the replacement sliding entrance door is fire-resistant.

14. A method according to claim 1 in which the replacement sliding entrance door comprises a hollow structure containing strengthening supports.

15. A method according to claim 14 in which the strengthening supports are channel-shaped.

16. A method according to claim 14 in which the replacement sliding entrance door is enclosed in sheet steel of a thickness of at least 16 gauge.

17. A method according to claim 3 wherein the replacement sliding entrance door slides behind the stationary panels.

18. A method according to claim 2 wherein the replacement sliding entrance door comprises a left sliding door and a right sliding door, both of which slide behind the side stationary panel.

19. A method according to claim 18 wherein the left sliding door slides behind the right sliding door, both of said doors sliding simultaneously, with the rate of slide of the left sliding door being sufficiently faster than that of the right sliding door to permit both the left and right sliding doors to complete the slide approximately simultaneously behind the side stationary panel.

20. A method according to claim 1 wherein the transom has a track and is positioned beneath the top post, and hanging the replacement sliding entrance door from the track on the transom.

21. A method according to claim 1 and installing a stationary side panel on the frame in the space formerly occupied by the adjacent wall.

* * * * *